United States Patent [19]

Scharf et al.

[11] Patent Number: 4,560,493

[45] Date of Patent: Dec. 24, 1985

[54] LIQUID RESIDUE REDUCING PREPARATIONS CONTAINING OCTANE-1-PHOSPHONIC ACID OR A WATER-SOLUBLE SALT THEREOF

[75] Inventors: Rolf Scharf, Monheim; Ferdinand Koch, Hilden; Hans-Joachim Schlüssler, Haan, all of Fed. Rep. of Germany

[73] Assignee: Henkel Kommanditgesellschaft auf Aktien, Düsseldorf, Fed. Rep. of Germany

[21] Appl. No.: 685,215

[22] Filed: Dec. 26, 1984

Related U.S. Application Data

[63] Continuation of Ser. No. 506,596, Jun. 22, 1983, abandoned.

[30] Foreign Application Priority Data

Nov. 4, 1982 [DE] Fed. Rep. of Germany ..... 3240687

[51] Int. Cl.[4] ..... C11D 3/06

[52] U.S. Cl. ..... 252/174.16; 252/135; 252/142; 252/173; 252/DIG. 17; 134/2; 134/3

[58] Field of Search ..... 252/174.16, DIG. 17, 252/DIG. 14, 173, 142, 156, 99, 135; 134/2, 3; 260/502.4 R

[56] References Cited

U.S. PATENT DOCUMENTS

| | | | |
|---|---|---|---|
| 3,870,560 | 3/1975 | Shumaker | 252/DIG. 14 |
| 3,951,826 | 4/1976 | Rasmussen | 252/DIG. 14 |
| 3,953,380 | 4/1976 | Sundby | 252/DIG. 14 |
| 4,105,573 | 8/1978 | Jacobsen | 252/DIG. 15 |
| 4,126,572 | 11/1978 | Tai | 260/502.4 R |

*Primary Examiner*—A. Lionel Clingman
*Assistant Examiner*—Hoa Van Le
*Attorney, Agent, or Firm*—Ernest G. Szoke; Nelson Littell, Jr.; Henry E. Millson, Jr.

[57] ABSTRACT

This invention relates to a liquid residue reducing composition. More particularly, this invention relates to a liquid residue reducing composition which comprises an aqueous solution containing an effective amount of octane-1-phosphonic acid or a water-soluble salt thereof and to the method of using said composition.

8 Claims, No Drawings

LIQUID RESIDUE REDUCING PREPARATIONS CONTAINING OCTANE-1-PHOSPHONIC ACID OR A WATER-SOLUBLE SALT THEREOF

This application is a continuation of application Ser. No. 506,596, filed June 22, 1983, now abandoned.

FIELD OF THE INVENTION

This invention is directed to preparations which reduce liquid residue. More specifically, this invention is directed to preparations containing octane-1-phosphonic acid or a water-soluble salt thereof which are useful in reducing or eliminating residues of aqueous solution on metal surfaces.

BACKGROUND OF THE INVENTION

When metal surfaces are treated with aqueous solutions or are rinsed with water, troublesome residues of liquid adhere to them. Liquid residues of this type cause problems in certain processing operations, for example, during the heating of cans or tins for preserved foods, insofar as they either dry out, forming unseemly stains, or leave behind a grey water haze. Also, in the event of subsequent contact with foods, it is not always possible to prevent undesirable changes, for example, in taste, from occurring. In instances such as these, therefore, it is advantageous if the residues are as small as possible and can be largely removed, for example, by treatment with hot air. However, treatment with hot air alone is unsatisfactory in view of the energy considerations.

For this reason, attempts have already been made to reduce residues of liquid adhering to metal surfaces by use of special additives. It is known that quaternary ammonium compounds may be used for this purpose. They are added either to the rinsing baths or to the actual treatment solutions for metal surfaces, which may contain, in addition to inorganic and/or organic acids, sodium hydroxide, potassium hydroxide, soda, surfactants, complexing agents, and inhibitors as well as solution promoters. With solutions such as these used in a concentration of 1% by weight, a residual water content of about 10 g/m$^2$ is obtained for a quaternary ammonium compound content of from about 0.05 to 1 gm/liter. With the same solutions used in the same concentration, but without any quaternary ammonium compounds added, the residual water content amounts to from about 20 to 40 gm/m$^2$, dependent upon the drainage time.

However, the use of quaternary ammonium compounds is unsatisfactory in many respects. Quaternary ammonium compounds foam too vigorously and, because of this, cannot be applied by spraying. In addition, even the smallest traces cause further processing problems with certain foods because there is the danger of migration from the interface into the food. Finally, quaternary ammonium compounds cannot be used with solutions containing surface-active anionic substances.

OBJECTS OF THE INVENTION

It is an object of the invention to provide preparations which reduce liquid residues.

It is also an object of the invention to provide preparations containing octane-1-phosphonic acid or a water-soluble salt thereof which reduce or eliminate residues of aqueous solution.

It is a further object of the invention to provide a method of reducing or eliminating liquid residues on metal surfaces which have been treated or rinsed with aqueous solution.

These and other objects of the invention will become more apparent in the discussion below.

DETAILED DESCRIPTION OF THE INVENTION

Applicants have found that the above-mentioned disadvantages may largely be overcome by use of the preparations described hereinafter containing additives which reduce residues of liquid adhering to metal surfaces. These preparations are characterized by a content of octane-1 -phosphonic acid or a water-soluble salt thereof.

Suitable water-soluble salts include sodium, potassium, and alkanolamine salts. Octane-1 -phosphonic acid or its water-soluble salts are used in the treatment solution in quantities of from about 0.02 to 1 gm/liter, preferably from about 0.1 to 0.3 gm/liter. It has been found to be advantageous to add solubilizers, such as cumene sulfonate, or alcohols, such as glycol, ethanol, or propanol, to the preparation according to the invention to improve the solubility of octane-1-phosphonic acid or its water-soluble salts.

The results achieved with the additives used in accordance with the invention are surprising because the effects described above are not obtained in cases where alkyl phosphonic acids containing alkyl radicals shorter or longer than that of octane-1-phosphonic acid, are used.

The preparations according to the invention may be adjusted to an alkaline, neutral, or acidic pH-value.

The examples below are intended to illustrate the invention and should not be construed as limiting the invention thereto.

EXAMPLES

Example 1

Concentrates having the compositions set forth in the table below were used to prepare solutions having a concentrate concentration of 1% by weight in water having a hardness of 16° dH (dH=deutsche Härte=German Hardness). The solutions were used to treat chrome-nickel steel plates having a surface area of 100 cm$^2$ for about five minutes at 18° C. The plates were then removed from the various cleaning solutions and suspended vertically for one minute. The quantity of solution adhering was then determined.

The concentration compositions and the test results were as follows:

TABLE

| | Concentrate No. | | | | | |
|---|---|---|---|---|---|---|
| | 1 | 2 | 3 | 4 | 5 | 6 |
| Component (% by weight) | | | | | | |
| cumene sulfonate, 40% | 7 | 7 | 7 | 7 | 7 | 7 |
| phosphoric acid, 75% | 40 | 40 | 40 | 40 | 40 | 40 |
| distilled water | 53 | 51 | 51 | 51 | 51 | 51 |
| butane-1-phosphonic acid | — | 2 | — | — | — | — |
| hexane-1-phosphonic acid | — | — | 2 | — | — | — |
| octane-1-phosphonic acid | — | — | — | 2 | — | — |
| decane-1-phosphonic acid | — | — | — | — | 2 | — |
| docosane-1-phosphonic acid | — | — | — | — | — | 2 |
| Quantities adhering (ml/m$^2$): | 20.1 | 20.7 | 21.9 | 4.9 | 19.5 | 20.9 |

As can be seen from the table, the quantity of solution adhering is drastically reduced where octane-1-phosphonate is used. No adhering film of water was left behind after subsequent rinsing with water having the same hardness. The plate was virtually dry.

Example 2

Aluminum plates (99.5%) were treated with a 1% by weight solution of Concentrates 1 (no additive) and 4 under the same conditions as in Example 1. An adhering residue of solution of 24.1 ml/m$^2$ was obtained in the case of Concentrate 1, and a residue of 10.8 ml/m$^2$ was obtained in the case of Concentrate 4, which contained octane-1-phosphonic acid.

Example 3

A concentrate consisting of 10% by weight of cumene sulfonate, 2% by weight of octane-1-phosphonate, 0.5% by weight of the adduct of 10 mols of ethylene oxide onto nonyl phenol, and the remainder distilled water, was added in a concentrate concentration of 0.5% by weight to an autoclave filled with can material consisting of tin plate. After heating, the can material was sprayed briefly with water in the usual way. No film of water was left on the cans, which were thus stainless in appearance.

Example 4

A concentrate for reducing residues of adhering water consisting of 5% by weight of phosphonobutane tricarboxylic acid, 5% by weight of octane-1-phosphonic acid, 1% by weight of the adduct of 8 mols of ethylene oxide onto nonyl phenol, 10% by weight of sodium hydroxide and/or potassium hydroxide, and the remainder distilled water, was diluted with water (hardness 16° dH) to a concentrate concentration of 2% by weight and used for treating the surface of chromenickel steel at 50° C. After repeated use of the concentrate, the film of rinsing water quickly disappeared completely from the surface.

Example 5

A concentrate consisting of 5% by weight of octane-1-phosphonic acid, 3.5% by weight of triethanolamine, and the remainder distilled water, was added to the rinsing water of a flow-type autoclave containing can material. The quantity was measured in such a way that the concentrate was diluted to a concentration of around 0.5%. The film of water drained off from the treated can material without leaving any residues. The can material could be subsequently labelled without any problems.

We claim:

1. A method of reducing the liquid residue remaining on a metal surface treated with aqueous solutions or rinsed with water which consists of contacting said surface having a liquid residue with an aqueous solution containing from about 20 to 1000 mg/liter of octane-1-phosphonic acid or a water-soluble salt thereof.

2. The method of claim 1, wherein the solution contains from about 100 to 300 mg/liter of octane-1-phosphonic acid or a water-soluble salt thereof.

3. In the process of reducing the liquid residue remaining on metal surfaces of containers for foods, after treatment with aqueous solutions and before insertion of foods, by employing an additive in said aqueous solution, the improvement consisting of contacting said metal surfaces with an aqueous solution containing from about 20 to 1000 mg/liter of octane-1-phosphonic acid or a water-soluble salt thereof, as said additive.

4. The process of claim 3, wherein said aqueous solution contains from about 100 to 300 mg/liter of octane-1-phosphonic acid or a water-soluble salt thereof.

5. The process of claim 3 wherein said containers for foods have metal surfaces selected from the group consisting of chromenickel steel, aluminum and tin plate.

6. In the process of reducing the liquid residue remaining on metal surfaces of cans or tins for preserving foods after treatment with aqueous solutions and before insertion of foods to be preserved therein, by employing an additive in said aqueous solution, the improvement consisting of contacting said metal surfaces with an aqueous solution containing from about 20 to 1000 mg/liter of octane-1-phosphonic acid or a water-soluble salt thereof, as said additive.

7. The process of claim 5, wherein said aqueous solution contains from about 100 to 300 mg/liter of octane-1-phosphonic acid or a water-soluble salt thereof.

8. The process of claim 5 wherein said cans or tins have tin plate metal surfaces.

* * * * *